US007487905B2

(12) United States Patent
McClure

(10) Patent No.: US 7,487,905 B2
(45) Date of Patent: Feb. 10, 2009

(54) CONTAINER HAVING END WALL TOP PANEL SUPPORT AND ASSOCIATED CONTAINER BLANK

(75) Inventor: Jack A. McClure, Omaha, NE (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/171,046

(22) Filed: Jun. 30, 2005

(65) Prior Publication Data

US 2007/0000985 A1 Jan. 4, 2007

(51) Int. Cl.
*B65D 5/20* (2006.01)
*B65D 5/468* (2006.01)

(52) U.S. Cl. ..... 229/143; 229/117.16; 229/152; 229/154; 229/918

(58) Field of Classification Search ..... 229/117.16, 229/141, 142, 143, 152, 153, 154, 190, 191, 229/915, 918, 919
See application file for complete search history.

(56) References Cited

U.S. PATENT DOCUMENTS 2,316,261 A * 4/1943 Levkoff ..... 229/152
2,857,090 A * 10/1958 Fallert ..... 229/154
4,319,710 A * 3/1982 Osborne ..... 229/190
4,546,913 A * 10/1985 Castillo ..... 229/191
5,000,377 A * 3/1991 McClure ..... 229/918
5,285,956 A * 2/1994 Piepho ..... 229/191
5,289,970 A * 3/1994 McClure ..... 229/143
5,588,585 A * 12/1996 McClure ..... 229/191
5,649,663 A * 7/1997 Pestow, Jr. ..... 229/190
5,673,848 A * 10/1997 Garza ..... 229/191
6,402,020 B1 * 6/2002 McClure ..... 229/143
6,595,411 B2 * 7/2003 McClure ..... 229/143

FOREIGN PATENT DOCUMENTS

GB 2236305 A * 3/1991 ..... 229/190

* cited by examiner

*Primary Examiner*—Gary E Elkins

(57) ABSTRACT

The embodiments of the present invention provide a blank foldable material that may be configured to form a container. When formed, the container is self-locking and includes top panel assemblies that form additional bearing surfaces. The blank is configured to form a container that includes corners having multiple thicknesses. However, despite the multiple thickness of the corner assemblies, the panels are only adhered in one location per corner. The single adhesion/corner arrangement provides a multi-wall corner arrangement that is strong, yet has flexible applications. The single adhesive/corner adds vertical stacking strength and lateral stability between the panels. The unique approach of only adhering at one place per corner is a space and cost saving improvement that maintains a container integrity and usefulness.

4 Claims, 7 Drawing Sheets

CONTAINER HAVING END WALL TOP PANEL SUPPORT AND ASSOCIATED CONTAINER BLANK

FIELD OF THE INVENTION

This invention relates generally to cellulose-based blanks and containers and more specifically, to wood cellulose-based blanks and containers used for storing and displaying goods.

BACKGROUND

Containers having multiple thickness corner assemblies are useful where increased container integrity is desired. However, a standard practice employed with using containers with multiple thickness corner assemblies is to adhere all the relative panels together with glue or other type adhesive. In order to erect a container with all relative panels adhered together either large numbers of people hand setting the container, or large box equipment is necessary. Both of these add significant costs.

What is needed is a method for erecting and the subsequent container that is simple to erect, cost effective and maintains desired container integrity.

BRIEF DESCRIPTION OF THE DRAWINGS

Various embodiments of the present invention are described in detail below with reference to the following drawings.

DETAILED DESCRIPTION

The present invention provides a blank and resulting container for holding any variety of goods by way of overview and with references to FIGS. 1 through 7. An embodiment of the present invention includes a single piece blank 20 of foldable material arranged to form a container 50. Specific details of the blank 20 in container 50 are described with more particularity below.

Figure 1:
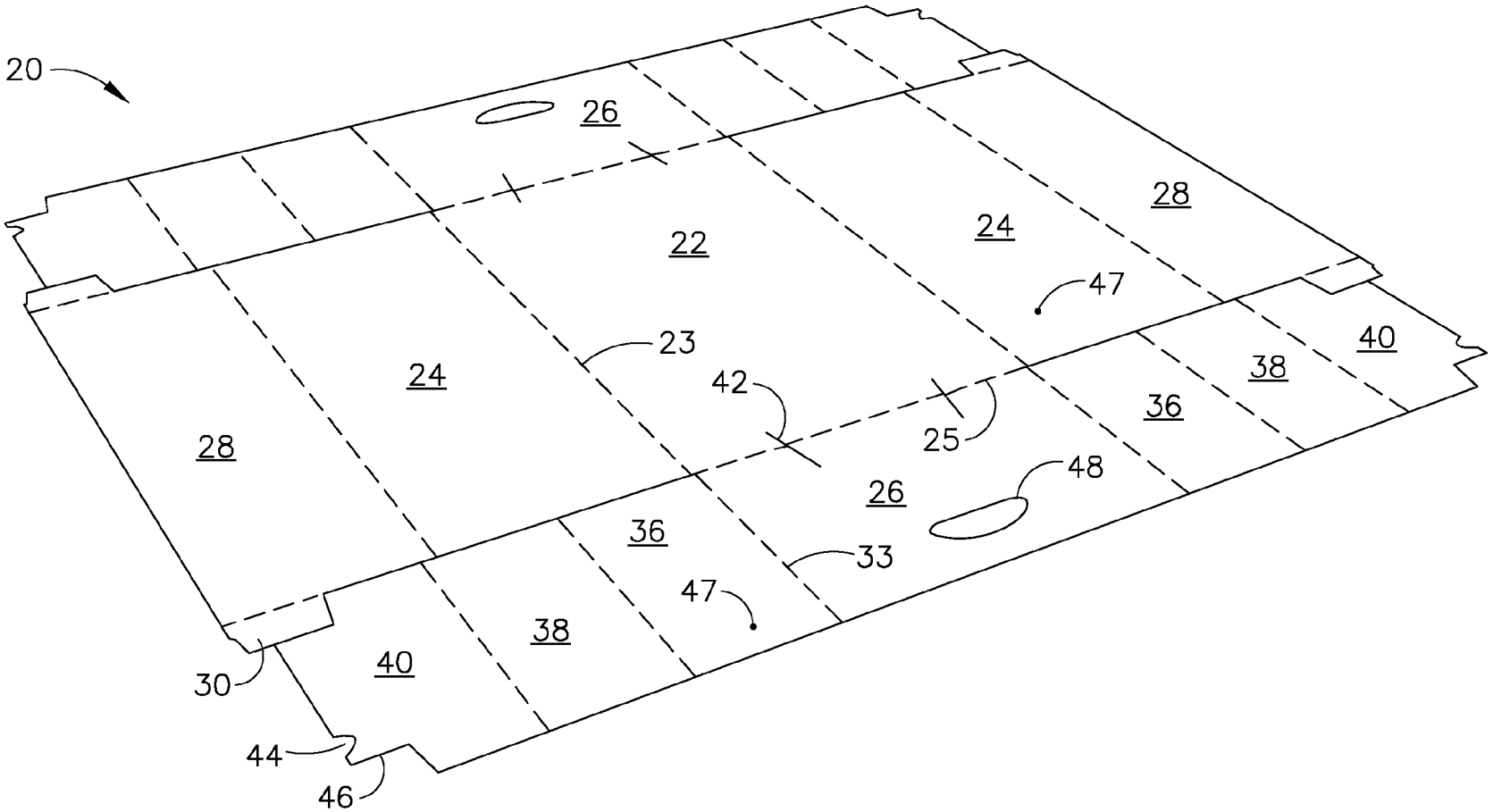
FIG. 1 is a plan view of a single piece of container plank formed in accordance with an aspect of the present invention.

FIG. 1 depicts a blank 20 used to form the container 50. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The various forms may also be constructed in single wall, double wall, or triple wall configuration. The blank 20 is cut and scored, perforated or otherwise formed to include a plurality of panels that when assembled form container 50. In all FIGURES, like numbers indicate like parts. Additionally, cut lines are shown as solid lines, score lines as dashed lines, and lines of perforation as broken lines.

With respect to FIG. 1, the blank 20 includes a bottom panel 22, opposed side panels 24 and opposed end panels 26. The bottom panel 22 is generally rectangular in shape and is connected with the side panels along a fold line 23. The bottom panel 22 is connected with end panels 26 along a fold line 25. As depicted in the FIGURE, fold line 23 is substantially perpendicular to fold line 25. The intersection of the respective fold lines 23 and 25 substantially define the corner of the bottom panel 22 and subsequent container 50.

Attached to the side panel 24, opposite the bottom panel 22, is a top panel 28. Top panel 28 is attached to side panel 24 along a fold line 27. The length of the top panel 28 measured along fold line 27 is substantially equal to the length of the side panel 24 measured along the same fold line. The width of the top panel 28, measure in a direction perpendicular to fold line 27, in a direction away from side panel 24, is about ½ the width of the bottom panel 22 measured along fold line 25.

Top panel 28 includes a top panel flap 30 which is connected to top panel 28 along fold line 29. Fold line 29 is lies substantially perpendicular to fold lines 27 and 23. The length of the top panel flap 30 when measured perpendicularly from fold line 29 and in a direction away from the top panel 28 is substantially equal to the width of side panel 26 measured along fold line 33.

End panel 26 includes a corner assembly that when erected into a container, form a unique corner configuration. The corner assembly generally includes a first corner assembly panel 36 attached with the end panel 36 along a fold line 33. Fold line 33 is substantially parallel to fold line 23 and is substantially formed in the same plane. Connected with the first corner assembly panel 36 opposite the end panel 26 is a second corner assembly panel 38. The second corner assembly panel is connected to the first corner assembly panel 36 along a fold line 35. Connected with the second corner assembly panel 38 is a third corner assembly panel 40. Said third corner assembly panel 40 is connected to second corner assembly panel 38 along a fold line 37. Fold lines 33, 35 and 37 are substantially parallel to one another.

As formed, the first corner assembly panel 36, second corner assembly panel 38, and third corner assembly panel 40 lie substantially adjacent to side panel 24 and portions of top panel 28 and top panel flap 30. In an embodiment, the collective widths of the panels making up the corner assembly (36, 38, and 40) measured along cut line 43 are greater than or equal to the length of the side panel measured along fold line 23. However, it will be appreciated that the collective widths could also be less than the length of the side panel measured along fold line 23.

In order to further illustrate the various aspects of the embodiments, FIGS. 2 through 7 show the blank 20 being erected into container 50.

Figure 2:
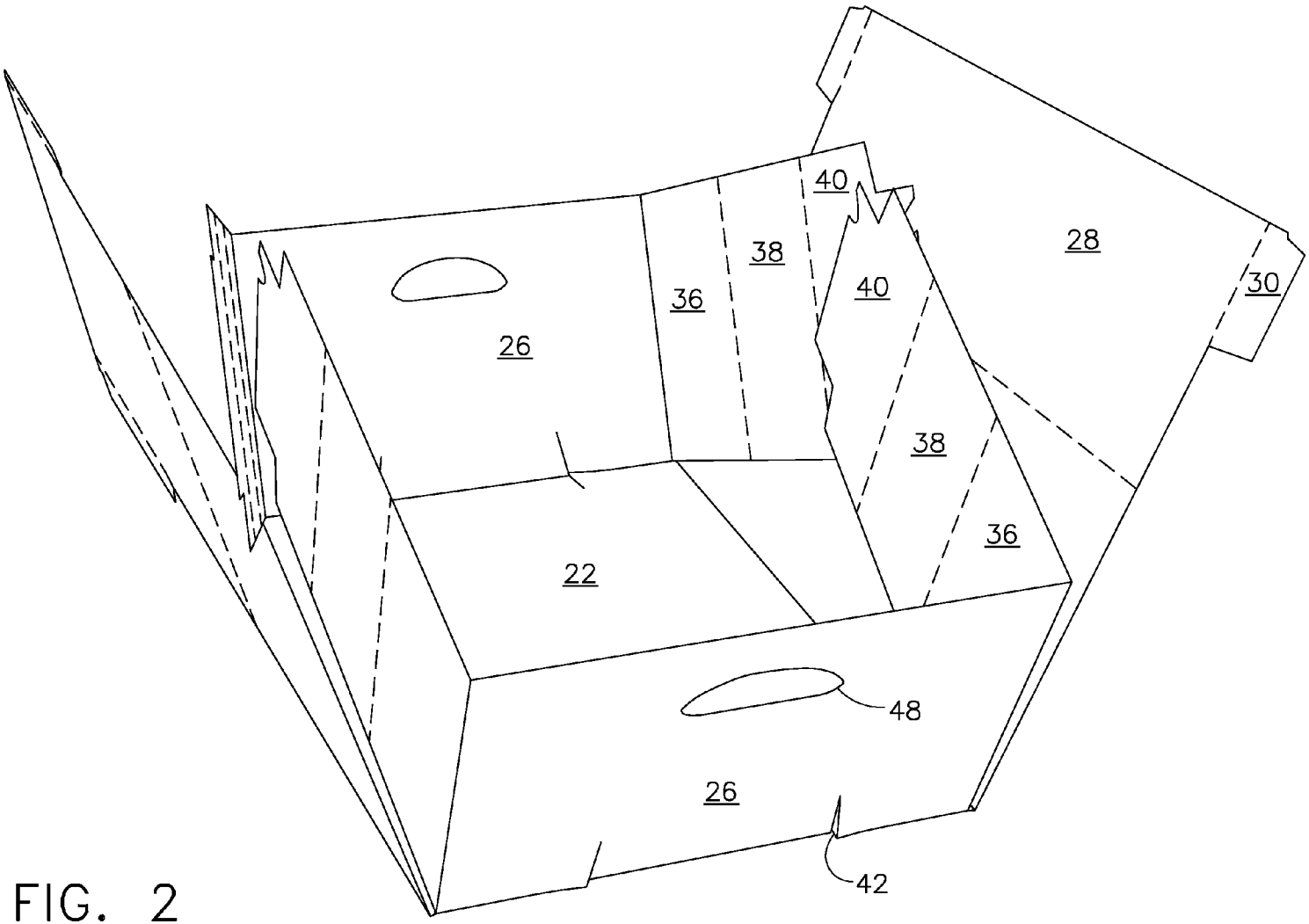
FIG. 2 is a perspective view of a partially assembled container assembly according to an aspect of the present invention.
Figure 3:
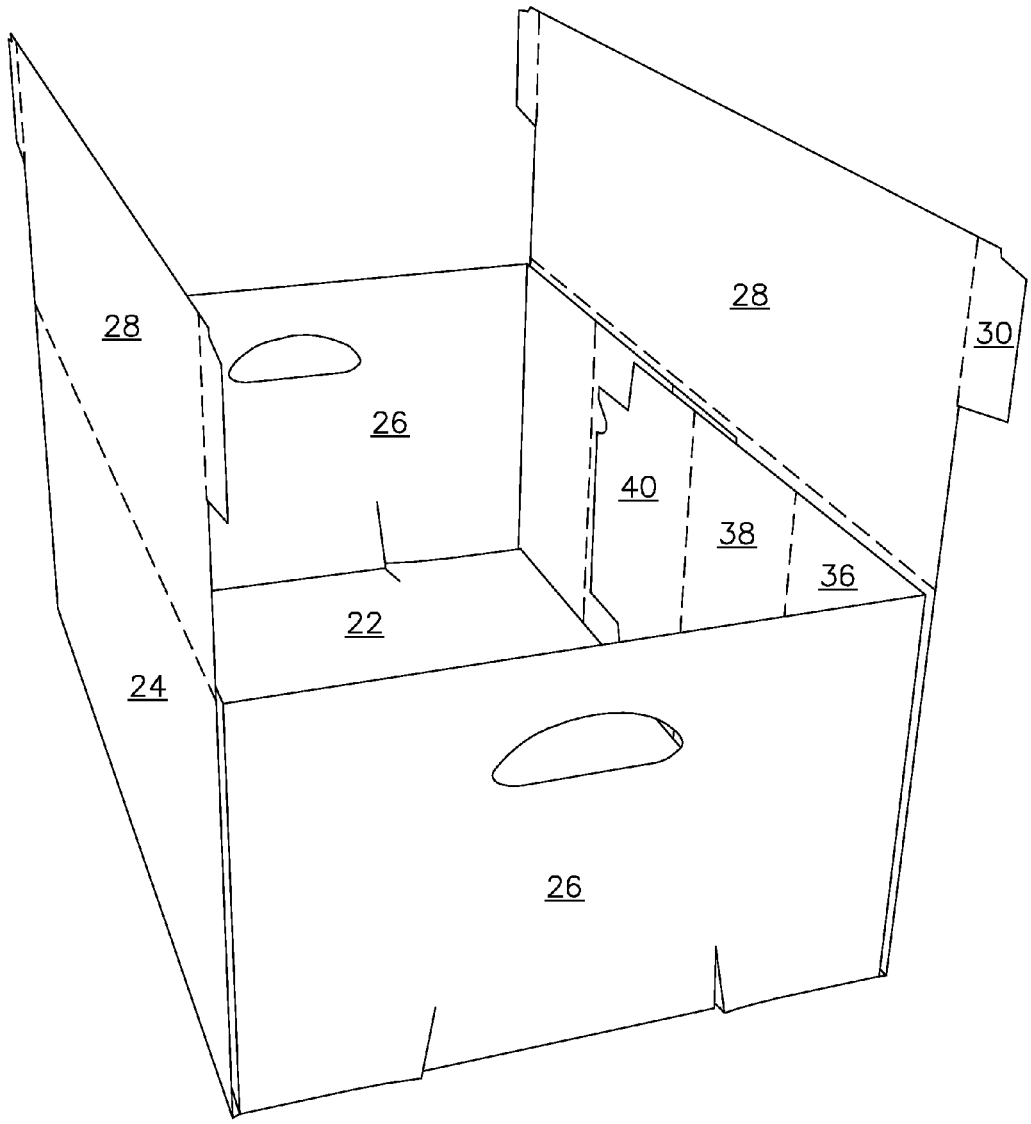
FIG. 3 is another perspective view of a partially assembled container assembly according to yet an another aspect of the present invention.

With specific reference to FIGS. 2 and 3, the assembly of the container 50 is initiated by folding the first corner assembly panel 36, second corner assembly panel 38, and third corner assembly panel 40 upwardly approximately 90 degrees on fold line 33. The end panel 26 may also be folded upwardly approximately 90 degrees along a fold line 25. As best seen in FIG. 2, this forms a substantially U-shaped structure including the end panels 26 and the opposed corner assembly panels. Also, this places the respective corner assembly panels that are attached to the opposed end panels 26 in a substantially juxtaposed relationship to one another. The next step in the box erection process is to fold side panels 24 upwardly approximately 90 degrees so that side panel 24 is juxtaposed to the various corner assembly panels, as best seen in FIG. 3.

Figure 4:
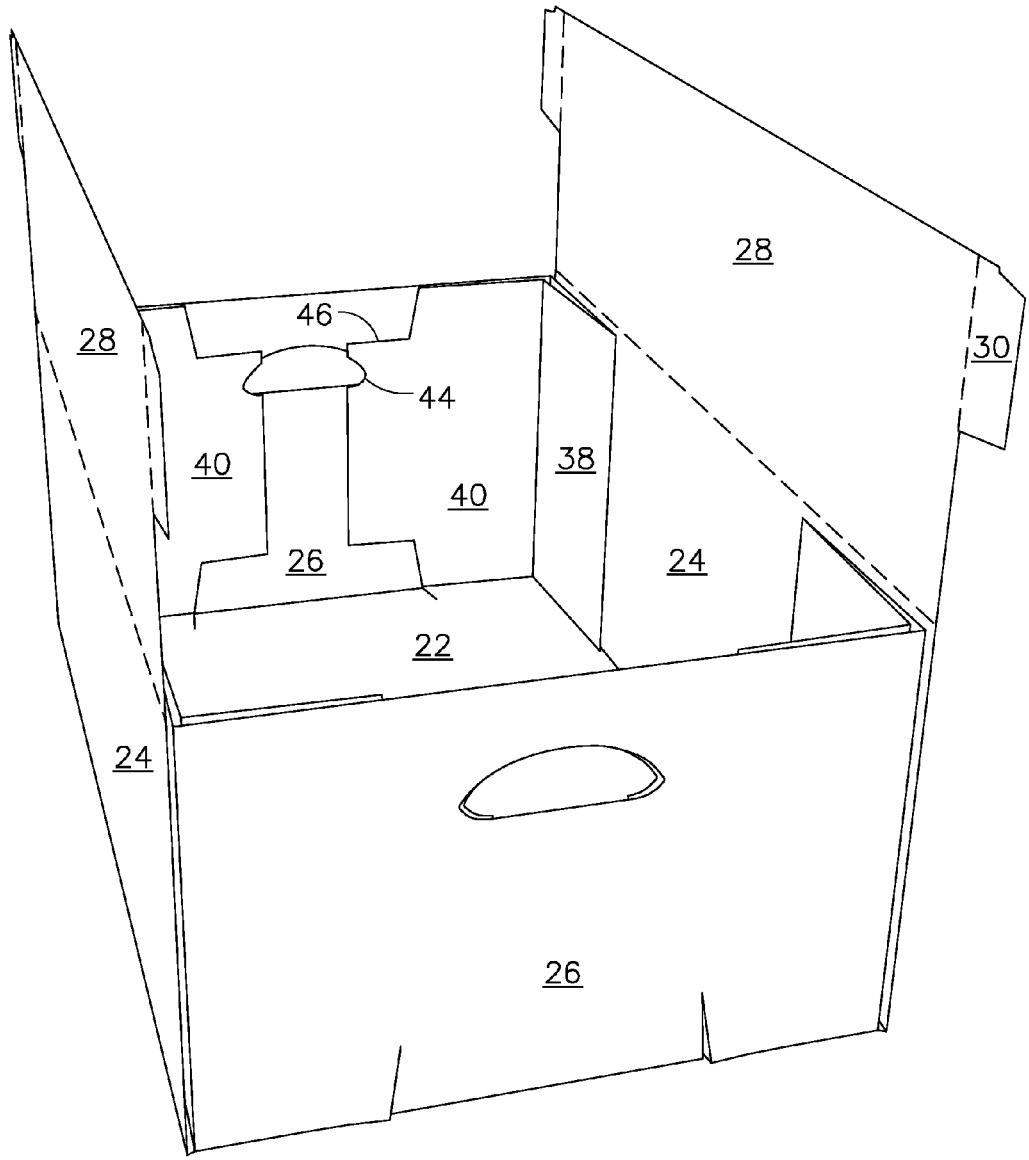
FIG. 4 is still further another perspective view of a partially assembled container assembly according to an aspect of the present invention.
Figure 5:
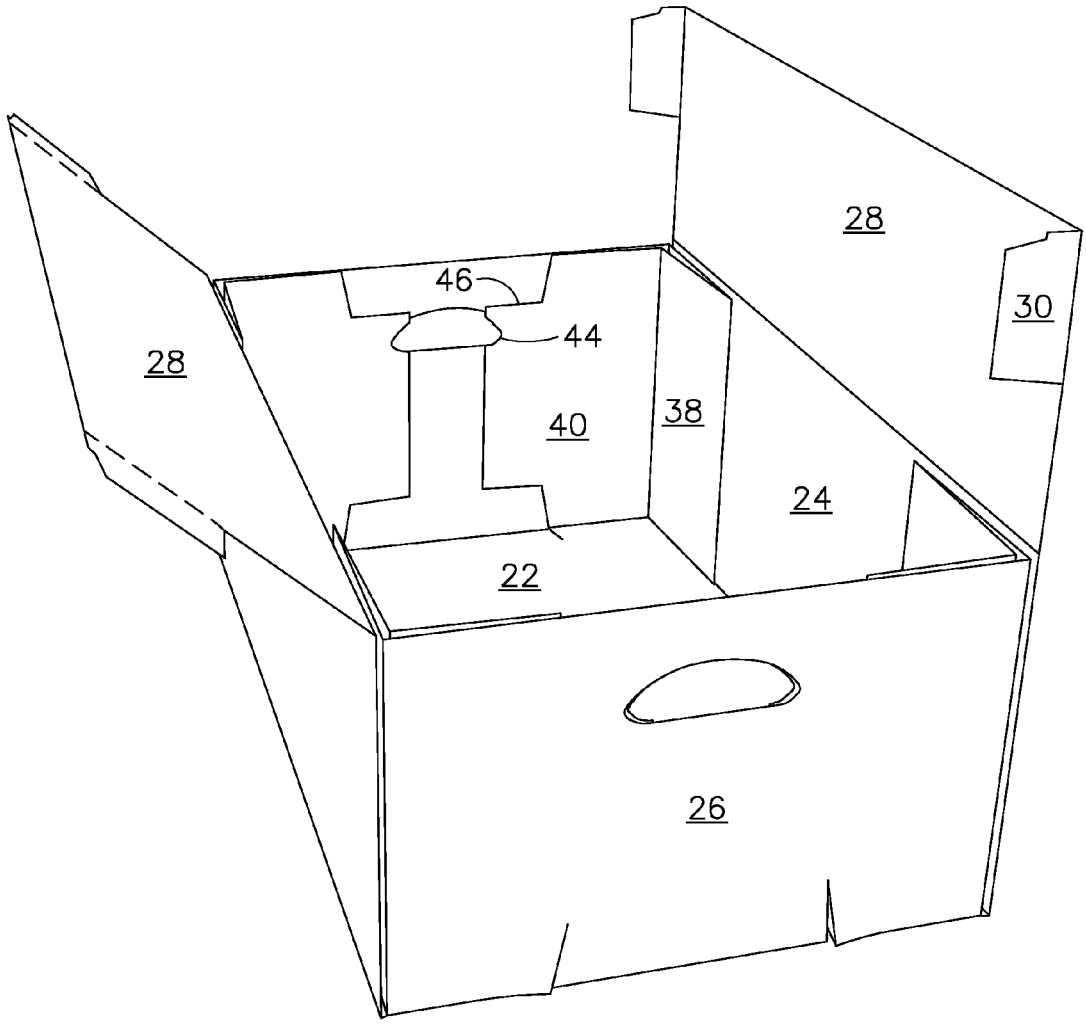
FIG. 5 is still further another perspective view of a partially assembled container assembly according to an aspect of the present invention.

With specific reference to FIGS. 4 and 5, the assembly of the L-corners and end wall top panel support is depicted. Specifically, the second corner assembly panel 38 and third corner assembly panel 40 are folded inwardly approximately 180 degrees along fold line 35. As such, fold line 37 is substantially in the corner of the container 50, the third corner assembly panel 40 is adjacent to the end panel 26, and the second corner assembly panel is substantially adjacent to the first corner assembly panel. At this time, the free third corner assembly panel 40 may be engaged into the end panel slot 42 to lock the L-corner panels together, as best seen in FIG. 5.

Figure 6:
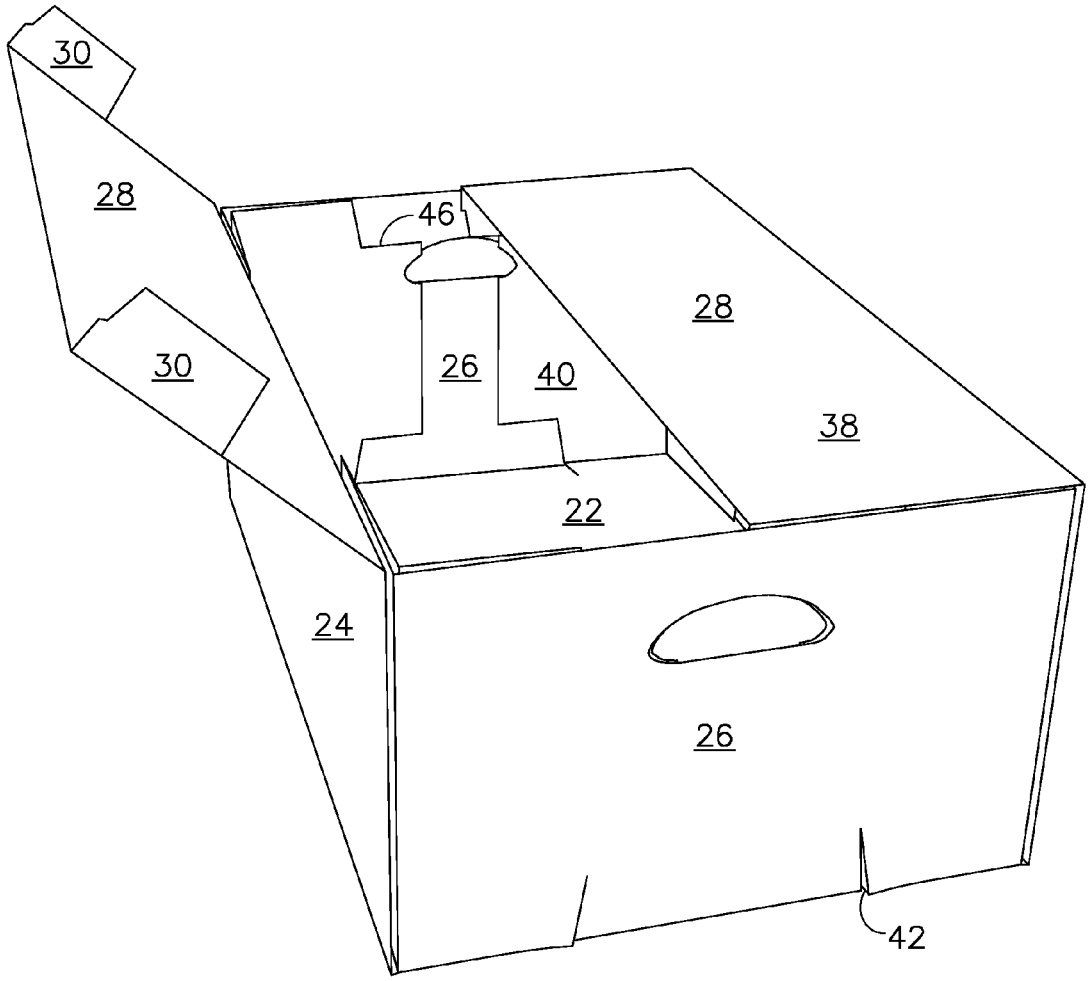
FIG. 6 is still further another perspective view of a partially assembled container assembly according to an aspect of the present invention; and, FIG. 7 is still further another perspective view of a partially assembled container assembly according to an aspect of the present invention.
Figure 7:
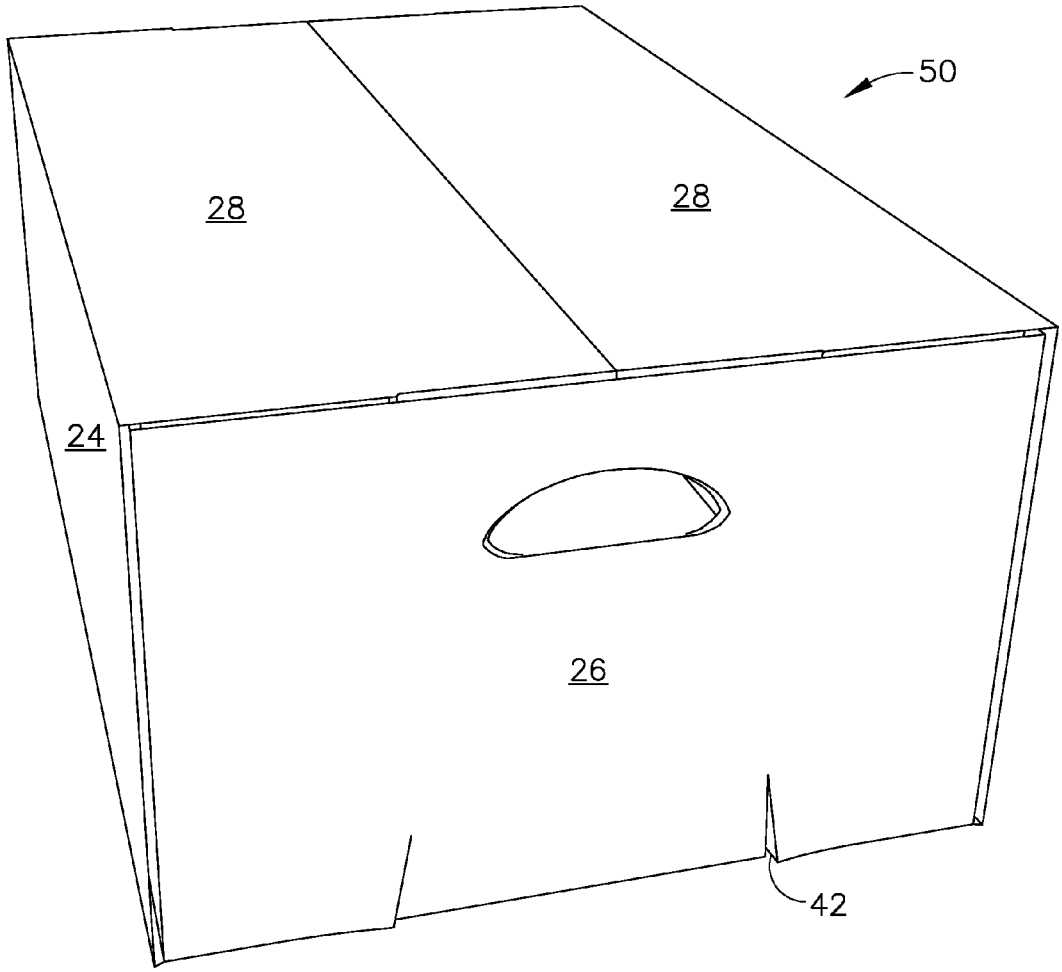

With specific reference to FIGS. 6 through 7, the top panel flaps 30 may then be folded inwardly approximately 90 degrees along fold line 29. Top panel 28 may then be folded inwardly approximately 90 degrees along fold line 27. In this manner the container may be formed closing the lids, wherein the top panels 28 receive additional support from the top panel flaps 30 extending between the top panel 28 and the bearing surface created by top panel support cutout 46.

It will be appreciated by those skilled in the art that the relationship of the top panel flap 30, top panel support cutout 46 and end panel 26 aid to the stability of the container 50. Specifically, FIG. 7 depict the container 50 that results from the assembly of blank 20. As can be seen in this FIGURE, the container 50 includes reinforced multi-panel corner arrangements. Specifically, all four corners receive added rigidity thanks to the overlapping relationship of the various side corner assembly panels and their respective side wall 24 or end wall 26. The arrangement of the corner assembly panels help the container 50 control relative motion of the side panels 24 and end panels 26. The corner assembly panels also provide a significant increase in the container's stacking strength. Further, top panel 28 provides a stacking or bearing surface for successive containers 50 to be stacked vertically on top of one another (not shown).

One of the many unique features of this embodiment is the extremely limited use of adhesive. Specifically, with reference to all FIGURES, the only adhesive used in the formation and use of container 50 is located between side panel 24 and the first corner assembly panel 36. The specific location where the adhesive 47 is placed between the respective panels will be known to those skilled in the art and it its location shown in FIG. 1 is strictly exemplary. However, it will be appreciated that the location and amount of adhesive 47 used will be sufficient to ensure container integrity. The other panels are essentially free from adhesive or the like. They may be hand set and are generally friction fit.

A unique benefit is that the forming of container 50 may be done much more efficiently than before. Specifically, if box formers are to be used in erecting the container 50, a box former having a relatively small footprint may be use. Suitable, non-limiting examples of such a box formers are the vertical box formers manufactured by either FWF, Inc. or W.E. Plemons, Inc. each of these companies manufacture relatively simple box formers having footprints around 4'×6'. This footprint is significantly smaller than box formers typically used to erect fully glued containers. If the container 50 is to be fully hand set rather either partially or fully machine formed, the number of people required to erect the container is greatly reduced.

The simple adhesive arrangement of the disclosed container 50 and the minimal assembly space requirement provides a variety of efficiencies for a user. As discussed above, the actual floor space needed for either machine formation or hand formation is reduced by the unique and limited adhesive 47 application. This reduced floor space usage is a cost savings. Also, smaller entities that formerly could not justify the expense of larger box erecting equipment may now utilize less voluminous box erecting equipment and produce a container 50 having desirable structural qualities.

The container 50 as shown is simple to manufacture, easy to assemble and may be a design of considerable usage in club stores or bulk stores where products are sold in large quantities on the open floor. The container 50 may be erected by standard box erecting equipment (not shown) or else is may be hand-set and tape/glued when needed. However, this design is also useful in any variety of retail or wholesale environments.

While various embodiments of this invention have been illustrated and described, as noted above, many changes can be made without departing from the spirit and scope of this invention. Accordingly, the scope of the invention is not limited by the disclosure of the various embodiments. Instead, the invention should be determined entirely by references to the claims that follow.

What is claimed is:

1. A single sheet of foldable material cut and scored to define a container, comprising:

a bottom panel;

an end panel connected with the bottom panel;

a side panel connected with the bottom panel;

a first corner assembly panel adjacent the side panel;

a second corner assembly panel adjacent the first corner assembly panel;

a third corner assembly panel adjacent the end panel;

a top panel hingedly attached to said side panel, opposite said bottom panel;

a top panel flap connected with said top panel by a fold line, said top panel flap defining a top panel flap profile; and, a top panel flap support cutout formed in a top edge of said third corner assembly panel, said top panel support cutout having a profile that substantially matches a portion of the top panel flap profile, said top panel support cutout extending below the hinged attachment of the top panel with the side panel;

wherein the first corner assembly panel is adhered to the side panel, and all other panels friction fit only.

2. The container of claim 1, wherein the single sheet of foldable material is formed from a cellulose-based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

* * * * *